US007487871B1

(12) United States Patent
Bellofatto, Jr. et al.

(10) Patent No.: US 7,487,871 B1
(45) Date of Patent: Feb. 10, 2009

(54) PADFOLIO WITH TAPERED ELASTIC OUTER POCKET

(75) Inventors: Richard C. Bellofatto, Jr., Peabody, MA (US); Mark T. Salander, Barrington, RI (US); Joshua B. Lederer, Brookline, MA (US); Quincy L. Reese, Brockton, MA (US)

(73) Assignee: The Gem Group, Inc., Lawrence, MA (US)

( * ) Notice: Subject to any disclaimer, the term of this patent is extended or adjusted under 35 U.S.C. 154(b) by 773 days.

(21) Appl. No.: 10/696,963

(22) Filed: Oct. 30, 2003

(51) Int. Cl.
*A45C 11/34* (2006.01)
*A45C 1/06* (2006.01)

(52) U.S. Cl. ..... 206/214; 150/131; D3/299; D3/900

(58) Field of Classification Search ..... 206/214 X, 206/224, 371, 305, 320, 472, 473; 150/106, 150/131 X, 135; 190/108; D3/299 X, 900 X, D3/303
See application file for complete search history.

(56) References Cited

U.S. PATENT DOCUMENTS 788,060 A * 4/1905 Otto ..... 150/131
D381,506 S * 7/1997 Roeder ..... D3/245
D421,526 S * 3/2000 Isaacson ..... D3/303
6,213,267 B1 * 4/2001 Miller ..... 190/108
6,298,993 B1 * 10/2001 Kalozdi ..... 206/581
2002/0121322 A1 * 9/2002 Seamon ..... 150/113

* cited by examiner

*Primary Examiner*—Jila M Mohandesi
(74) *Attorney, Agent, or Firm*—William A. Loginov; Loginov & Associates PLLC

(57) ABSTRACT

This invention provides a padfolio, portfolio, case, bag or other business accessory that carries, on an exterior surface, a pocket flap that is typically open at the top edge and joined at a bottom edge. It has a size sufficient to completely cover a predetermined range of conventional documents (or other items), and in one embodiment, has side walls that taper from a wider bottom that may be longer than the predetermined documents to a narrower top that is typically shorter than the predetermined documents so that the side edges of the predetermined documents are at least partially visible to evidence their presence in the pocket. A narrow elastic strip joins each of the opposing side edges to the exterior surface at a location along the exterior surface that is outboard of opposing edges of the predetermined documents so that they may slide into the pocket free of interference for the joint between the elastic strips and the exterior surface. The tension generated by the strips is, however, sufficient to maintain holding friction, via the pocket flap on the documents, but enables expansion of the flap to admit thicker items when desired, including machinery for providing decoration to the flap. In an illustrative embodiment, the strips may be less than one half the total length of the side edges.

5 Claims, 4 Drawing Sheets

PADFOLIO WITH TAPERED ELASTIC OUTER POCKET

RELATED APPLICATION

This application is related to U.S. Design patent application Ser. No. 29/192,834, entitled PADFOLIO WITH TAPERED OUTER POCKET by Joshua B. Lederer, et al.

BACKGROUND OF THE INVENTION

1. Field of the Invention

This invention relates to padfolios, portfolios, cases bags and other business accessories with outer pockets.

2. Background Information

Padfolios, portfolios, cases, bags and other business accessories are widely used and a variety of shapes and styles are available. These items carry a wide range of sleeves and pockets along their interior and exterior surfaces. Outer pockets are particularly useful for often-used papers, or those that must be put-away or retrieved rapidly without resorting to the potentially more-time-consuming task of accessing the item's interior. Exterior pockets may contain zippered closures for added security and to pre-vent inadvertent loss of documents, etc. However, the more secure a pocket, typically the harder it is to retrieve documents therefrom—and the more difficult it becomes to identify whether the documents are even present in the pocket. Overlying all these concerns in pocket design is the fundamental desire for a stylish look for both the pocket and overall item.

SUMMARY OF THE INVENTION

This invention overcomes the disadvantages of the prior art by providing a folio, padfolio, portfolio, case, bag or other business accessory that carries, on an exterior surface, a pocket flap that is typically open at the top edge and joined at a bottom edge. It has a size sufficient to completely cover a predetermined range of conventional documents (or other items), and in one embodiment, has side walls that taper from a wider bottom that may be longer than the predetermined documents to a narrower top that is typically shorter than the predetermined documents so that the side edges of the predetermined documents are at least partially visible to evidence their presence in the pocket. A narrow elastic strip joins each of the opposing side edges to the exterior surface at a location along the exterior surface that is outboard of opposing edges of the predetermined documents so that they may slide into the pocket free of interference for the joint between the elastic strips and the exterior surface. The tension generated by the strips is, however, sufficient to maintain holding friction, via the pocket flap on the documents, but enables expansion of the flap to admit thicker items when desired, including machinery for providing decoration to the flap. In an illustrative embodiment, the strips may be less than one half the total length of the side edges.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
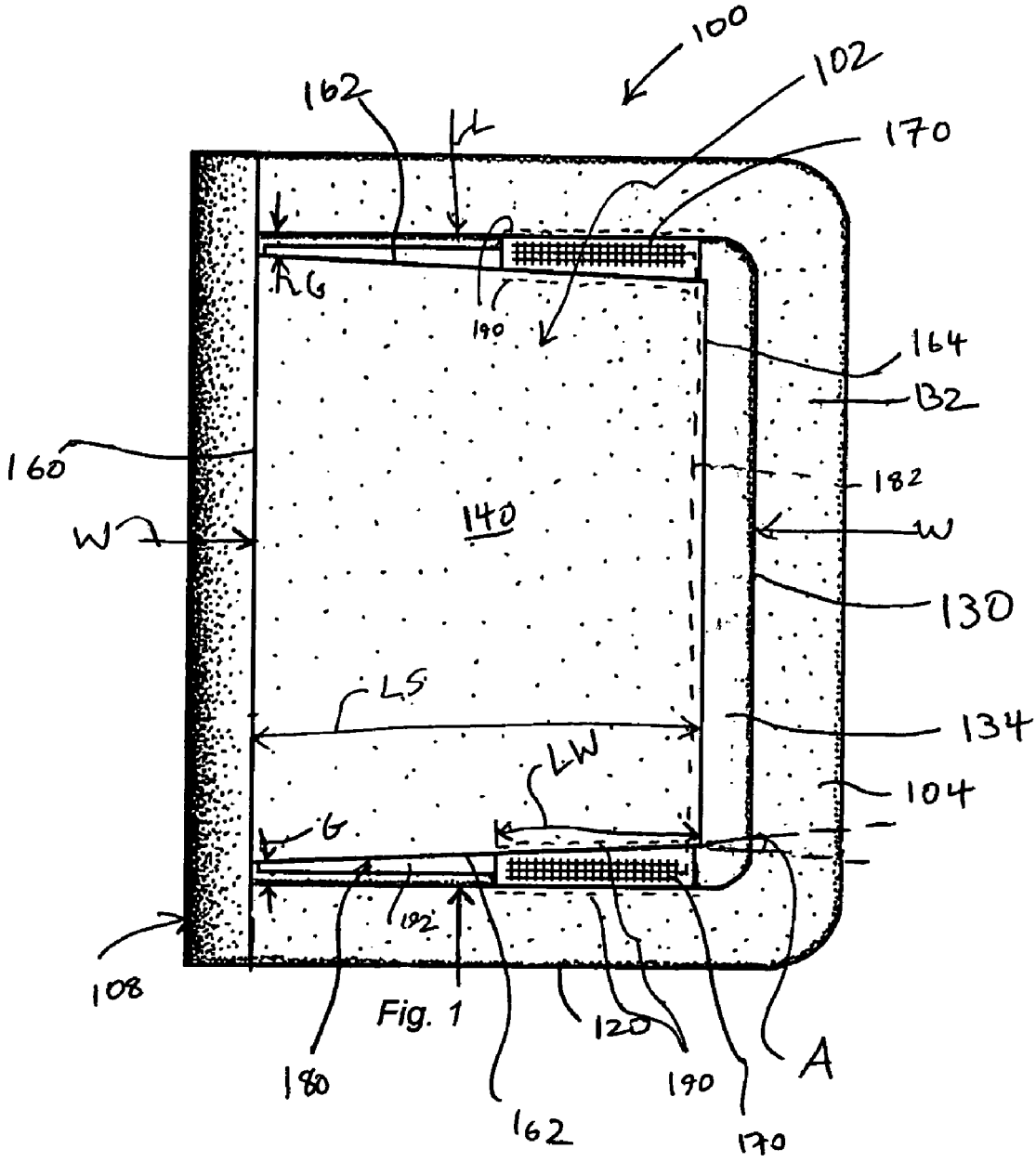
FIG. 1 is top view of a padfolio having a tapered pocket that contains exemplary documents according to an embodiment of this invention.

FIG. 1 shows a top view of a padfolio or portfolio 100 having an exterior pocket 102 along an exterior face cover 104. As shown in greater detail in FIG. 2, the exterior cover 104 is joined by a spine 108 to an opposing exterior cover 202. The covers can be opened in the manner of a book to reveal the interior (not shown). The joints between sections of the portfolio or padfolio 100 can be made by adhesives, stitching, welding or a combination of techniques. In general, the materials used can vary for each component of the portfolio or padfolio (or any other business accessory to which this invention is applicable). The facing material for the exterior covers of the padfolio or portfolio 100 in this embodiment is imitation leather. However, natural leather, cloth or any other suitable material can be used. The interior of the portfolio or padfolio is widely variable and is, thus, not shown. In general, the interior can include a variety of pockets, sleeves, binder rings and mountings for various electronic devices. The perimeter edge 120 of each exterior cover can be stitched or smooth with a seal detail. The covers 104, 202 can be spanned (along the perimeter remote from the spine 108) by a cloth closure 210 (FIG. 2) that can include a zipper (not shown) or other securing device. Alternatively, the covers can be unjoined except for the spine.

At points remote from the edges of the exterior surface of the cover 104 there is a defined perimeter edge 130 that, in this embodiment, comprises a separate piece of material joined beneath the perimeter-adjacent section 132 of the exterior surface. This separate internal base piece 134 is optional. In this embodiment it extends to join the spine 108. Its outer perimeter edge 130 defines a roughly rectangular dimension that is sized slightly larger than the largest item to be stored in the exterior pocket. In this example, the outer perimeter edge can define a width W or approximately 9 inches and a length L of approximately 11½ inches (suitable for storing an 8½× 11-inch sheet). However, these dimensions are highly variable as are the dimensions of the overall portfolio, padfolio, case, bag or other business accessory according to this invention. In fact, it is contemplated that the concepts described herein can be applied to any number of cases or other business accessories having external pockets and that the size of the case and its respective external pocket can be highly variable. In general, the size of the external pocket should be made slightly larger than the largest item expected to be stored therein.

The material of the base piece 134 can be varied. It can be the same material as the surrounding cover exterior (132), or it can be another acceptable material, such as a spun or woven fabric material.

While not shown, each exterior cover 104, 202 can include an internal stiffener and padding as appropriate. Alternatively, the pocket 102 according to this invention can be applied to a soft-sided (unstiffened) item.

With particular reference to FIG. 1, located within the inner perimeter edge 130 is an external pocket flap 140 according to an illustrative embodiment of this invention. This flap 140 is constructed from two or more plies of material. The external-most side can be constructed from the same material as the surrounding exterior (e.g. imitation leather), or from different materials. The internal side can be constructed from the same material as the surrounding exterior, or in an illustrative embodiment, from an appropriate spun/woven fabric. Within the inner structure flap 140 can be mounted a stiffener of rigid plastic or cardboard. Such a stiffener is not shown, but any conventionally designed stiffener can be used. Alternatively, the plies of the flap 140 may be sufficiently rigid to provide all desired structural strength without a separate internal stiffener.

The base of the flap 140 is fixedly attached to the spine 108 at a bottom or base seam edge 160. The flap 140 can be sewn, adhered with adhesives, or otherwise firmly attached to the spine 108 along its entire length at this edge 160. Extending forwardly from the base seam 160 are two opposing side edges 162 that meet at a front edge 164. The side edges 162 and the front edge 164 remain essentially unattached with respect to the flap base member 134 or cover 104. Significantly, the side edges 162 extend at a gap G from the seam with respect to the associated side edge of the base piece 134. They extend at an angle A that provides a taper toward the front edge 164. The angle A in this example is between approximately 2 and 5 degrees. However, the precise angle of taper is highly variable. In fact, it is contemplated, according to this invention, that a variety of edge shapes and details can be provided. In alternate embodiments, the side edges 162 can be curved and/or include decorative cutouts and shapes. They can also be vertical (e.g. perpendicular) with respect to the seam line 160, and/or simply recessed at a gap with respect to the side edges of the base piece 134.

A significant reason that a variety of edge details can be provided to the side edges 162 of the pocket flap is that there is no need to attach them firmly to the exterior flap. Rather, they are attached by a pair of opposing elastic webbing strips 170 placed near (for example, within approximately an inch of) the front edge 164 of the flap 140. The width LW of the elastic webbing is highly variable. In one embodiment, it is approximately 3-4 inches long. In an illustrative embodiment, the webbing's width LW is generally less than one half the length of extension LS of the side edge. In this manner, the webbing is sufficient to provide adequate attachment length between the side edge 162 and the base piece 134 of the exterior cover 104, while still exposing a significant portion of the side edge 162 between the webbing 170 and the seam 160. Of course, the size and shape of the elastic webbing can vary depending upon the required holding strength of the pocket and the overall size of the pocket and item to which it is attached. In general, attachment of the webbing is accomplished by stitching (see stitches 190) the webbing between plies of the flap 140 on one end, and between the cover exterior 132 and inner base piece 134 on the other end.

Notably, by exposing the side edges 162 along at least a portion of their lengths, and by providing them with an internal taper or other recessed detail, an item that recedes completely into the pocket, such as the narrow sheet, 180 (having a front edge that is covered as shown by the dashed line 182) is often still partially exposed on at least one side (see exposed side 192). This serves as a clear indication to the owner as to whether the pocket is full or empty.

Figure 2:
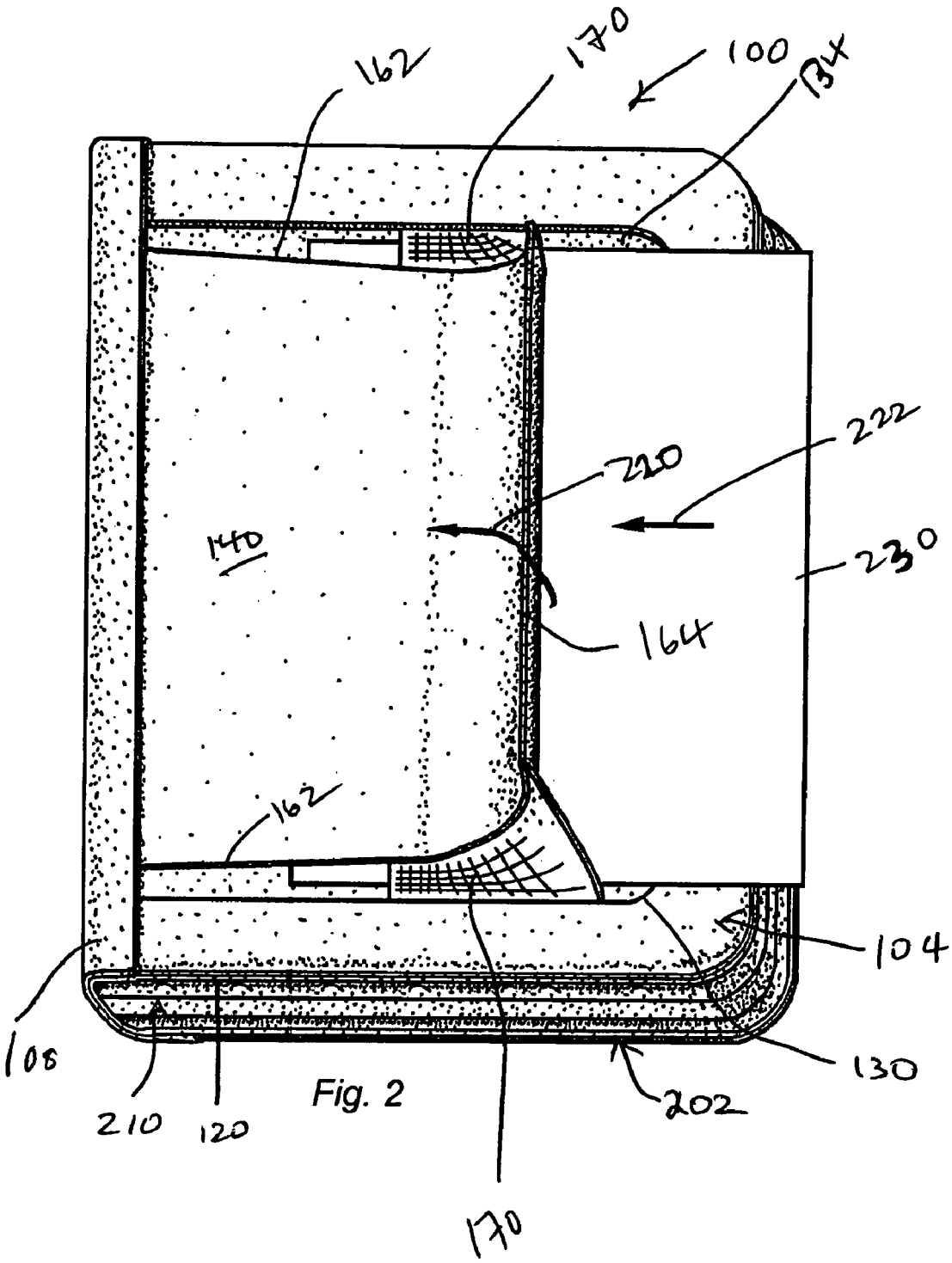
FIG. 2 is a top view of the padfolio of FIG. 1 detailing the entry of documents into the tapered pocket with associated flexure and stretch of the elastic strips.
Figure 3:
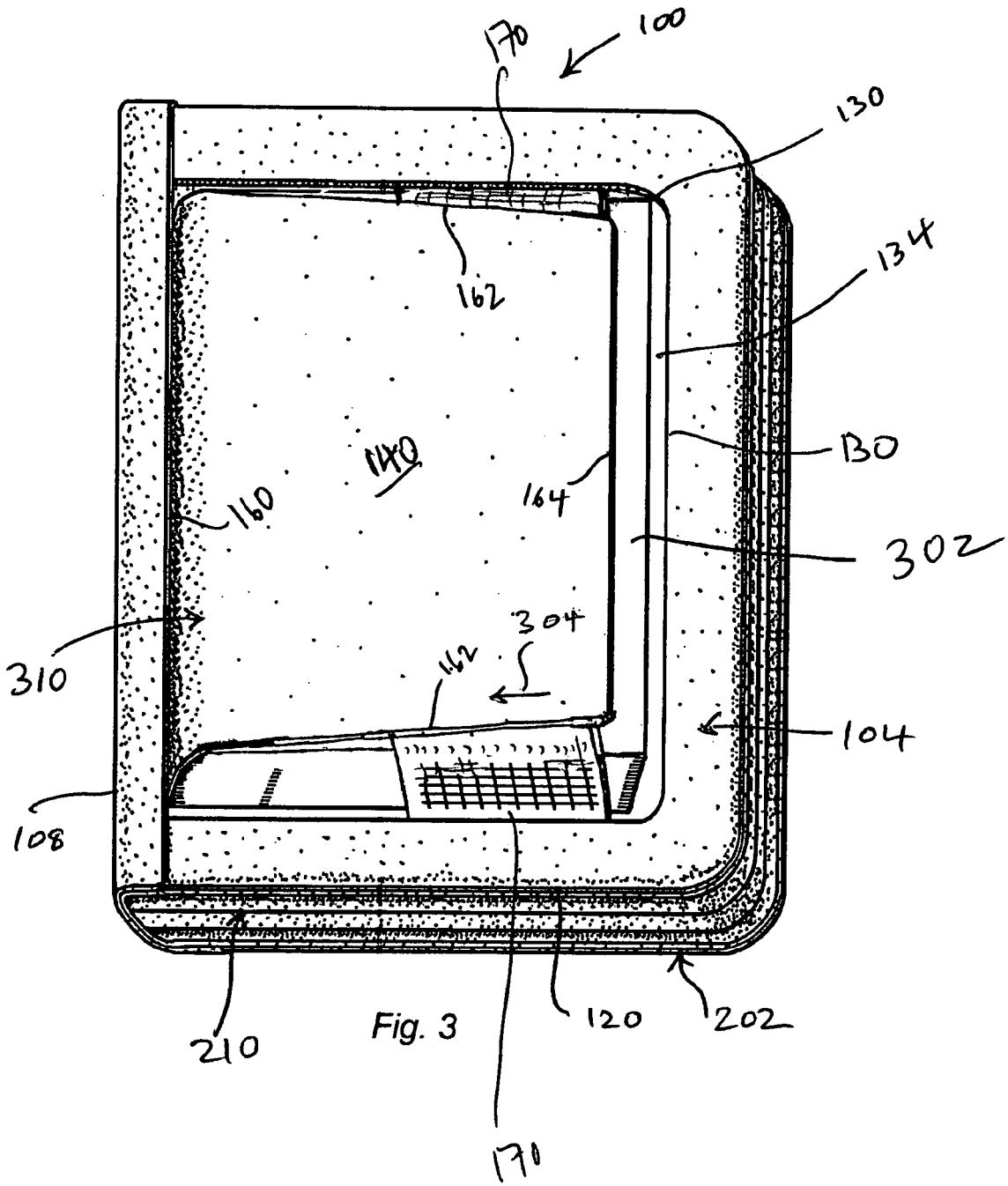
FIG. 3 is a top view of the storage in the tapered pocket of a thick stack of documents as facilitated by corresponding stretch of the elastic strips.
Figure 4:
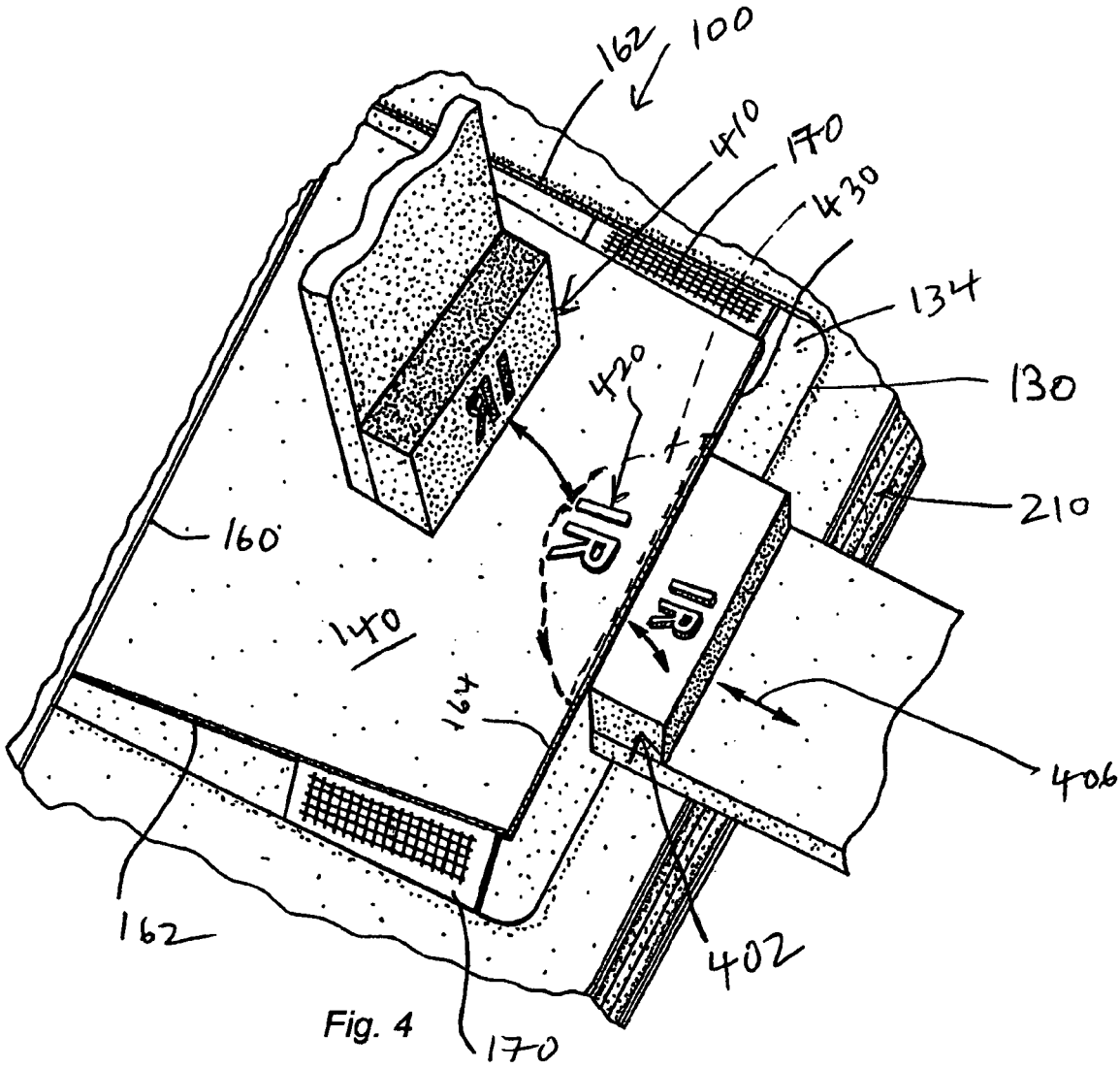
FIG. 4 is a partial perspective view of the movement of the tapered pocket flap to accommodate a decorating mechanism.

The use of elastic webbing 170 also allows easier placement of contents into the pocket. As shown in FIG. 2, the front edge 164 of the flap 140 can be rotated (arrow 220) to allow a larger opening that more readily accommodates entry (arrow 222) of items, such as the sheet 230. Once an item is placed in the pocket, the elastic springs back under tension to return the flap to a flat position as shown in FIG. 1.

Because of the substantial flexibility and resilience of the elastic webbing, the pocket is capable of holding a relatively large stack of sheets or other thick items without damaging the pocket or compromising its holding strength. In this example, a stack of documents 302 is inserted into the pocket. The thickness of the stack is accommodated by flexure of each elastic webbing 170 upwardly and around the edges of the stack. Due to the elastic nature of the webbing, it also accommodates slight rearward movement (arrow 304) as the rear edge portion 310 of the flap 140 is drawn upwardly by the thickness of the stack. In other words, the flap moves rearwardly as space is taken-up by the stack bottom's thickness in the rear area 310. Each elastic webbing flexes rearwardly in part to accommodate this take-up of flap material at the rear. The stack is retained firmly within the pocket since the elastic webbing applies continuous tension to hold the flap 140 closely against the stack top.

The elastic webbing 170 also allows the flap 140 to be raised easily to accommodate the base 402 of an embossing or other decorating device. The base can be slid (double arrow 406) into and out of the underside of the flap 140 to provide a backing surface against which a stamp or other application member 410 is pressed. A resulting decoration or customization 420 is generated. Note that the front edge or another location along the flap can be provided with an optional micromolded soft polyvinylchloride (or similar material) tab 430. This tab, and a technique for printing on this tab, are provided in commonly-owned U.S. patent application Ser. No. 10/650,103, entitled DECORATION FOR BAGS AND CASES AND METHOD FOR APPLYING THE SAME by Frank J. Papa, et al., the teachings of which are expressly incorporated herein by reference. Because of the flexibility of the pocket, decorations can be provided along a variety of locations, including those relatively near the base edge 160. As should be clear, according to this description, a pocket secured by opposing strips of narrow elastic webbing with exposed edges along a significant portion thereof enables a variety of beneficial properties that are a substantial improvement over pockets that are fixed along substantially their entire length between their top edge and base.

The foregoing has been a detailed description of various embodiments of this invention. Modifications and additions can be made without departing from the spirit and scope thereof. For example, while elastic webbing is an illustrative mechanism for retaining the pocket against the surrounding exterior cover, it is contemplated that other elastic materials can be used including shock cords, elastomeric material sheets, and the like. Likewise, while a flat pocket flap is shown, the pocket flap can be contoured to fit a variety of items having irregular shapes. Finally, while the front edge of the pocket flap is shown as open, it is expressly contemplated that a closure fastener or flap can be provided to further secure the pocket in alternate embodiments. Accordingly, this description is meant to be taken only by way of example and not to otherwise limit the scope of the invention.

What is claimed is:

1. A padfolio having an exterior pocket along an exterior cover comprising:

a pair of opposing covers joined together by a spine on an edge of each of the opposing covers;

the exterior pocket being located on an exterior surface of one of the opposing covers, wherein the pocket is formed by a flap joined along a base edge, the base edge being joined the exterior surface adjacent to the spine;

the flap including a front edge unjoined to the exterior surface and thereby constructed and arranged to receive documents through the front edge, the flap further including two side edges, each side edge having a recess taper to partially reveal whether at least a single document is held within the pocket while the flap is tensioned against the exterior surface; and a pair of elastic strips connected between each side edge, respectively, and the exterior surface, the elastic strips generating tension and being constructed and arranged to maintain a holding friction against the documents, and the front edge and the two side edges being unattached to the cover except by the pair of elastic strips while a region in which documents may be viewed is visible along the side edges remote from the straps.

2. A padfolio with an exterior pocket along an exterior cover comprising:

a flap attached adjacent to a spine of the padfolio, where the flap creates a base edge adjacent to the spine, two side edges, and a front edge;

the front edge unattached to the exterior cover, and the front edge being adapted to allow documents to slide into the pocket through the front edge;

an outer perimeter edge stitched on the exterior cover in an approximately rectangular shape with one side adjacent to the base edge and the approximately rectangular shape being slightly larger then the flap; and the two side edges being unattached except by a pair of elastic strips attached between plies of the flap and the outer perimeter edge, and the two side edges including a taper defined as a gap between the outer perimeter edge and the side edge being narrower at the base edge and wider at the front edge, the taper partially revealing at least a single document within the pocket when the flap is tensioned against the exterior cover by the elastic straps.

3. The padfolio of claim 2, wherein the elastic strips being configured with a width less than half a length of the side edge.

4. The padfolio of claim 2, wherein the gap being configured by a width of the base edge being greater then a width of the front edge.

5. The padfolio of claim 4, wherein the gap being generated by an angle between approximately 2 and 5 degrees.

* * * * *